US005148206A

United States Patent [19]

Shidara

[11] Patent Number: 5,148,206

[45] Date of Patent: Sep. 15, 1992

[54] AUTOMATIC FILM PROCESSOR USING ULTRASONIC WAVE GENERATORS

[75] Inventor: Shinichi Shidara, Tokyo, Japan

[73] Assignee: Fuji Photo Film Co., Ltd., Kanagawa, Japan

[21] Appl. No.: 417,407

[22] Filed: Oct. 5, 1989

[30] Foreign Application Priority Data

Oct. 7, 1988 [JP] Japan ..... 63-251845
Dec. 28, 1988 [JP] Japan ..... 63-328980

[51] Int. Cl.[5] ..... G03D 3/04; G03D 3/08

[52] U.S. Cl. ..... 354/298; 354/299; 354/322; 354/328

[58] Field of Search ..... 354/316, 320, 321, 322, 354/328, 299, 298

[56] References Cited

U.S. PATENT DOCUMENTS

| | | | |
|---|---|---|---|
| 2,945,760 | 7/1960 | Ostergaard | 354/328 |
| 3,680,463 | 8/1972 | Attridge et al. . | |
| 4,099,194 | 7/1978 | Kummerl . | |
| 4,239,387 | 12/1980 | Ahrens | 354/320 |
| 4,515,456 | 5/1985 | Ferrante | 354/320 |
| 4,521,092 | 6/1985 | Ferrante | 354/328 |
| 4,652,106 | 3/1987 | Jurgensen et al. | 354/328 |
| 4,882,246 | 11/1989 | Ohba et al. | 354/320 |

FOREIGN PATENT DOCUMENTS

| | | | |
|---|---|---|---|
| 0000995 | 3/1979 | European Pat. Off. . | |
| 3504729 | 8/1985 | Fed. Rep. of Germany . | |
| 61-137151 | 6/1986 | Japan . | |
| 62-170961 | 7/1987 | Japan . | |
| 2075372 | 11/1981 | United Kingdom | 354/328 |

*Primary Examiner*—A. A. Mathews
*Attorney, Agent, or Firm*—Sughrue, Mion, Zinn, Macpeak & Seas

[57] ABSTRACT

An automatic film processor for passing an exposed film successively through developing, fixing and rinsing stations to effect continuous development thereof. The film is applied with ultrasonic vibrations as it moves through the treating liquids to accelerate the treating speed, the ultrasonic vibrations being applied to the film such that the surface of the film is not perpendicular to the direction along which the ultrasonic wave has its maximum directivity. Arrangements for further promoting the effect by the application of ultrasonic vibrations are also provided. By the combined use of the application of ultrasonic vibration and preheating of the film, processing speed is further increased. Preheating of the film is controlled depending on the integrated amount of the already processed film, the density of the developed image or the feed rate or moving speed of the film.

11 Claims, 11 Drawing Sheets

AUTOMATIC FILM PROCESSOR USING ULTRASONIC WAVE GENERATORS

BACKGROUND OF THE INVENTION

1. Field of the Invention

The present invention relates generally to an automatic film processor for passing an exposed film successively through developing, fixing and drying stations to effect automatic development of the film. More particularly, it relates to an automatic film processor in which an ultrasonic wave generator is assembled to effect more uniform processing at higher speed.

2. Prior Art Statement

The known automatic film processors for the automatic development of an exposed film includes roller conveyer type, loop type and horizontal conveying type. The roller conveyer type processor has a number of rollers for passing the film through deep vessels of respective treating stations, and thus has a disadvantage that the entire system becomes large in size due to the use of deep vessels containing the treating liquids and disposed in respective treating stations. In the loop type processor, the film is conveyed by rollers disposed above and below each of the treating liquid vesesl. The disadvantages of this type processor are similar to those of the roller type processor in that the size of the entire system becomes large and the construction thereof is complicated. In the horizontal conveying type processor, the film is conveyed linearly along a horizontal pass and treating liquids are sprayed onto the conveyed film. However, in order to complete the treatment in each treating station at a high speed, the film must contact with each treating liquid by a long pass along the horizontal direction, which results in increase of the size of the system.

On the other hand, each treating liquid is fatigued to be degraded as it is used. As a result, there arises a problem that the quality and the density of the developed film are affected by the fatigue or degradation of the treating liquids due to changes in performance characteristics of respective treatment, leading to difficulty for effecting uniform treatments. Particularly, the developer liquid is apt to be deteriorated by oxidation or other causes and the temperature thereof is also apt to change depending on the change in use condition, leading to detrimental fluctuation in density of the developed image and leading to unevenness of the developed image.

There is another problem that the moving speed of the film passing through any one of the treating stations is varied due to change in resistance in the pass or other causes. The density of the developed image might be changed by such a variation in moving speed of the film to result in uneven quality of the developed film.

OBJECTS AND SUMMARY OF THE INVENTION

Accordingly, a first object of this invention is to provide an automatic film processor for developing an exposed film at high speed under a stable condition, the film processor being small in size.

A second object of this invention is to provide an automatic film processor for developing an exposed film to effect stable processing even when the treating liquid has been fatigued or deteriorated with the lapse of time.

A third object of this invention is to provide an automatic film processor for developing an exposed film, by which the density of the developed image is maintained at a constant level to stabilize the quality of the developed film irrespective of possible fatigue or deterioration of the treating liquid or temperature change of the treating liquid.

A fourth object of this invention is to provide an automatic film processor for developing an exposed film to realize stable processing even when the moving speed of the film passing through a series of treating stations is fluctuated.

The first object of this invention is achieved by the provision of an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film, said film being moved along a pass disposed in the close range of the sound wave field including the remotest position at which the output sound pressure from said ultrasonic wave generating means takes the maximum amplitude, and said film having its face impinged by the ultrasonic wave generated by said ultrasonic wave generating means such that said face is not perpendicular to the direction along which said ultrasonic wave has its maximum directivity.

According to this invention, the processing speed is increased by the application of an ultrasonic wave to the film, the ultrasonic wave being applied obliquely relative to the surface of the film to be processed so that irregularity of the applied ultrasonic sound pressure is minimized.

In a preferred embodiment, the direction along which the ultrasonic wave has its maximum directivity is slanting relative to the moving direction of the film. The ultrasonic wave generating means may be provided in any one or more of the treating stations.

According to another embodiment of this invention, there is provided an automatic film processor for continuously developing an exposed film by passing said film successively through plural treating stations including developing, fixing and rinsing stations, which comprises:

a liquid surface regulating member provided in at least one of said plural treating stations and having its downside face dipped into the treating liquid; and an ultrasonic wave generating means provided in at least said one of said plural treating stations for applying ultrasonic vibrations to said film from the lower portion of said treating liquid through said treating liquid towards said downside face of said liquid surface regulating member;

said film being moved along a pass held to be spaced from said downside face of said liquid surface regulating member by a substantially constant gap.

According to this embodiment, the processing speed is increased by the application of an ultrasonic wave to the film and the treating liquid in the vicinity of the film is maintained to a constant temperature by the provision of a liquid surface regulating member, whereby the processing of the film is further accerelated.

The temperature control effect provided by the liquid surface regulating member may be further improved by suspending the member through a thermally insulating material.

According to a still further embodiment of this invention, provided is an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from the lower portion of the treating liquid used in said at least one treating station, said film being moved with its face coated with the photosensitive emulsion facing upside so that the photosensitive emulsion layer is directly exposed to said trteating liquid.

In this embodiment, the ultrasonic wave is applied to the downside of the film and the side of the film on which the emulsion layer is coated is faced upwards to be treated with the warm treating liquid in consideration of the fact that the quantity of treating liquid over the film is relatively small and thus easily heated and maintained at a constant temperature.

The first object of this invention may be achieved also by the provision of an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from the lower portion of the treating liquid used in said at least one treating station, and preheating means for preheating said film prior to entrance into said treating liquid.

Accordingly, the processing speed is further increased by the combined use of the ultrasonic wave and preheating of the film. The preheating means may comprise comprises a pair of heat rollers which serve also as a feed roller pair to immerse said film into said treating liquid.

The second object of this invention is achieved by the provision of an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from the lower portion of the treating liquid used in said at least one treating station, an integrator for integrating the amount of processing by said treating liquid, and preheating means for preheating said film prior to entrance into said treating liquid, the temperature of said film preheated by said preheating means is controlled depending on said amount of processing by said treating liquid.

In addition to increase the processing speed by applying an ultrasonic wave to the film under processing, the amount of processing by the treating liquid is integrated to monitor the fatigue or degradation of the treating liquid and the temperature of the film preheated by the preheating means is controlled depending on the amount of processing by the treating liquid.

The third object of this invention is achieved by the provision of an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from the lower portion of the treating liquid used in said at least one treating station, density inspecting means for inspecting the density of the developed image on said film, and preheating means for preheating said film prior to entrance into said treating liquid, the temperature of said film preheated by said preheating means is controlled in response to said density of the developed image.

The proceesing speed is increased by the application of an ultrasonic wave to the film and the density of the developed image is inspected to monitor the fatigue or degradation of the developing liquid, and the prehaeting temperature of the film is changed in response to the density of the developed image. The preheating means may comprise a pair of heat rollers which serve also as a feed roller pair to immerse said film into said treating liquid.

The fourth object of this invention is achieved by the provision of an automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from the lower portion of the treating liquid used in said at least one treating station, means for detecting the moving speed of said film conveyed through said treating liquid, and preheating means for preheating said film prior to entrance into said treating liquid, the temperature of said film preheated by said preheating means is controlled in response to said moving speed of said film.

The processing speed is increased by the application of an ultrasonic wave and the moving speed of the film to be treated is detected so that the preheating temperature of the film is controlled in respense to the moving speed of the film.

According to a further aspect of this invention, the condition of the film conveyed through the treating liquid is monitored to find occurence of any abnormality, such as non-smooth conveyance or jamming of the film, and the preheating of the film by the preheating means is stopped to prevent the film from being overheated even when the condition of the conveyed film is abruptly changed by any abnormal operation.

DETAILED DESCRIPTION OF THE INVENTION

Initially, the principle of the processing by the application of an ultrasonic wave will be described.

Figure 5:
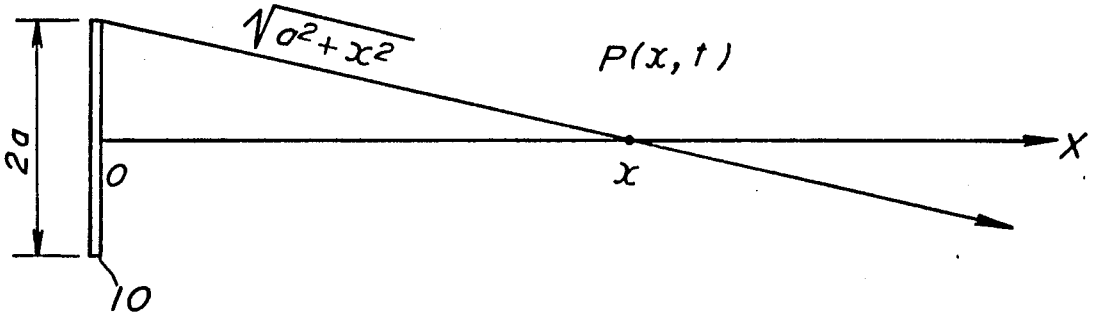
FIG. 5 is a graphical representation showing the maximum directivity of the ultrasonic wave vibrator.
Figure 6:
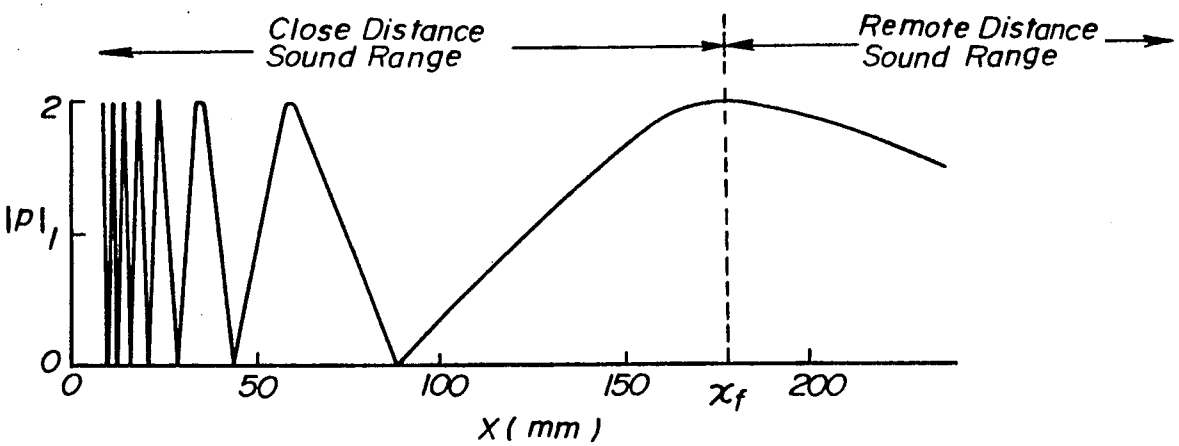
FIG. 6 shows the distribution of the sound pressure along the X-axis.
Figure 7:
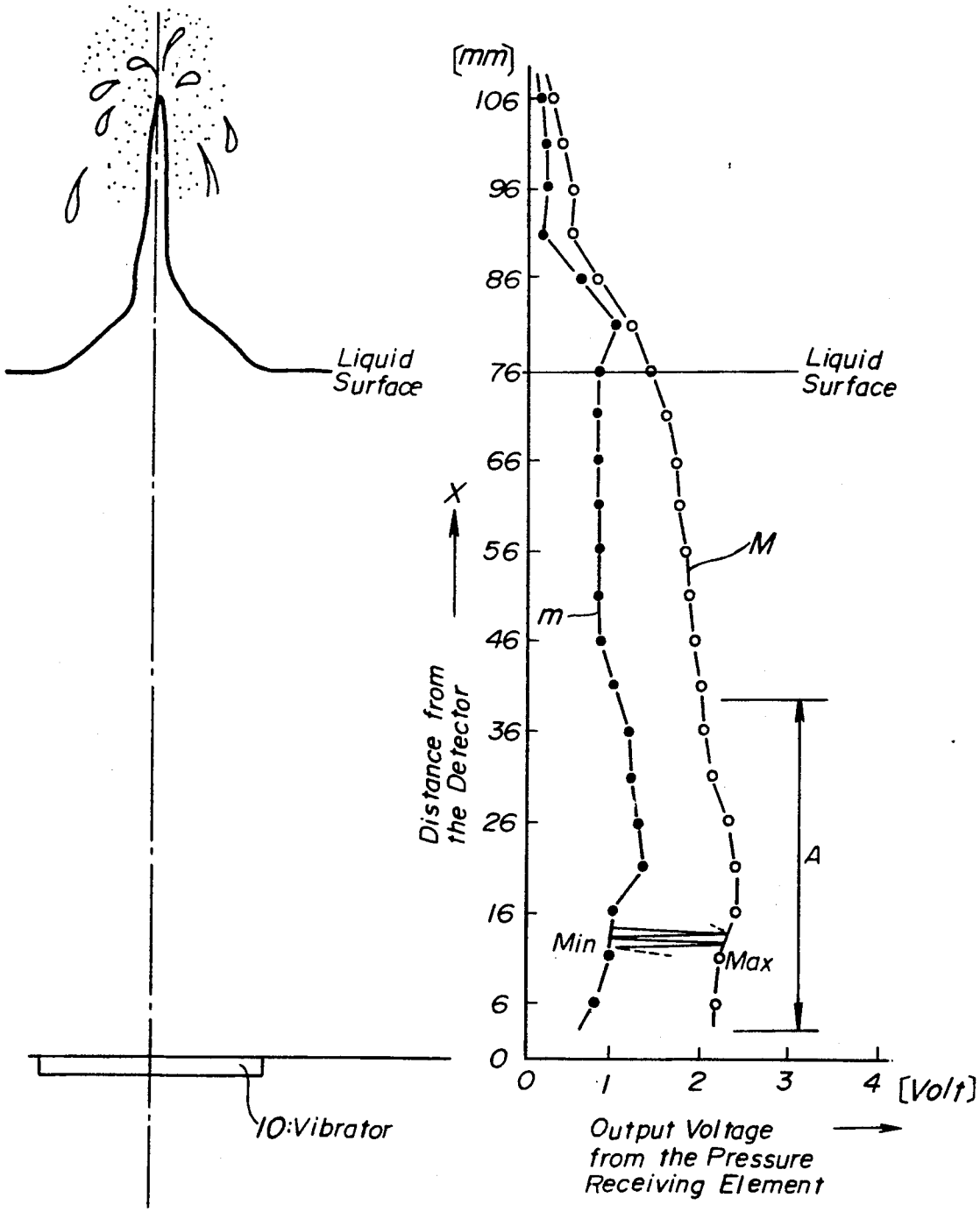
FIG. 7 is a graphical representation showing the result of measurement on a practical distribution of the sound pressure.

FIG. 5 shows an ultrasonic wave vibrator 10 and the also shows the co-ordinates having the X-axis which is coincident with the maximum directivity of the output from the vibrator 10. FIG. 6 shows the sound pressure distribution along the X-axis, and FIG. 7 shows a practical example of the sound pressure distribution.

A circular disk-shaped vibrator 10 having a diameter of 2a is used, and assuming that the vibrator 10 is a circular piston sound source, the sound pressure P at a point x may be represented by the following equation of:

$$P = 2P_0\sin\{k/2(\sqrt{a^2+x^2} - x)\} \times \exp j\{\omega t + \pi/2 - k/2(\sqrt{a^2+x^2}) + x\} \quad (1)$$

The absolute value |P| of the sound pressure is represented by the following equation of:

$$|P| = 2P_0|\sin\{k/2(\sqrt{a^2+x^2} - x)\}| \quad (2)$$

wherein $\omega=2\pi f$, $f.\lambda=c$, where f is the frequency, $k=2\pi/\lambda$ $\lambda$ is the wavelength and c is the sound velosity.

From the equation (2), the following relation is established at the point $x_0$ where the sound pressure takes the minimum value:

$$k/2(\sqrt{a^2+x^2} - x) = n\pi;\ (n = 1,2,\ldots) \quad (3)$$

Accordingly, we obtain $$x_0=(a^2/\lambda^2-n^2)/(2n/\lambda) \quad (4)$$

The point $x_m$ along the X-axis at which the sound pressure takes the maximum value can be obtained from the following equation of:

$$x_m=\{(a^2/\lambda^2-(n+\tfrac{1}{2})^2\}/\{((2n+1)\} \quad (5)$$

In an experiment where a vibrator 10 having a radius a=12.5 mm is used and vibrated at a frequency f=1.7 MHz, and assuming that the sound velocity c in the treating liquid is c=1500 m/sec., the points $x_0$ and $x_m$ may be plotted as shown in FIG. 6. The remotest maximum point $x_f$ at which the absolute value of sound pressure |P| takes the maximum value is represented by the following formula of:

$$x_f=a^2/\lambda-\lambda/4\approx a^2/\lambda \quad (6)$$

The sound range closer than the point $x_f$ is defined as the close distance sound range, and the sound range remoter than the point $x_f$ is defined as the remote distance sound range.

In the experiment described above, the remotest maximum point $x_f$ is calculated as follows.

$$x_f=177.6 \text{ mm} \quad (7)$$

In the present invention, an ultrasonic wave vibration is utilized within its close distance sound range, in order to reduce the size of respective treating vessel. The sound pressure is periodically changed at a frequency f. Since the sound pressure P at a certain point x on the center axis X is represented by a vibrating wave having an amplitude 2|P| which is duplicate of the sound pressure |P| shown in FIG. 6, the peak and the base of the sound wave appear alternately at every half frequency of:

$$\lambda/2=0.44 \text{ mm}$$

FIG. 7 shows the results of measurement conducted by generating sound pressure from the vibrator 10 mm and measuring the sound pressures within the circle having the diameter of 20 mm and surrounding the center axis X by a pressure receiving element comprised of a piezoelectric element. In FIG. 7, M indicates the maximum sound pressures and m indicates the minimum sound pressures. Within the sound range x=A close to the vibrator 10, strong and weak sound pressures appear alternately by every 0.44 mm intervals.

As will be understood from FIG. 7, if the film is placed near the center axis X, the sound pressure on the film surface is scatterred to cause uneven development unless the distance of the film from the surface of the vibrator is controlled with the accuracy of $0.44\pm\Delta x$ mm. According to an important aspect of this invention, the film is moved in the direction which is not perpendicular to the center axis X along which the ultrasonic wave generated from the vibrator 10 has its maximum directivity.

FIGS. 4A to 4D are illustrations showing variations in interrelation between the moving direction of the film 12 and the center axis X of propagation of the sound wave generated from the vibrator 10. In each of the embodiments shown in FIGS. 4A and 4B, the center axis X intersects the surface of the treating liquid at and angle $\alpha$ of $\pi/2$. The film 12 moves along a direction which is slanting relative to the center axis X in the embodiment shown in FIG. 4A, whereas the film 12 is turned in the treating liquid along a pass of spreading letter U in the embodiment shown in FIG. 4B. In each of the embodiments shown in FIGS. 4C and 4D, the angle $\alpha$ between the center axis X and the surface of the treating liquid is not $\pi/2$, and the film 12 moves along a pass which is generally parallel to the surface of the treating liquid. In the embodiment shown in FIG. 4C, a rising portion 14 is formed on the liquid surface by means of the ultrasonic vibration, and the film 12 moves through the rising portion 14. On the other hand, in the embodiment shown in FIG. 4D, the film 12 moves in the treating liquid below the rising portion 14.

FIRST EMBODIMENT

Referring now to FIGS. 1 and 2A to 2C, a first embodiment of this invention will now be described.

Figure 1:
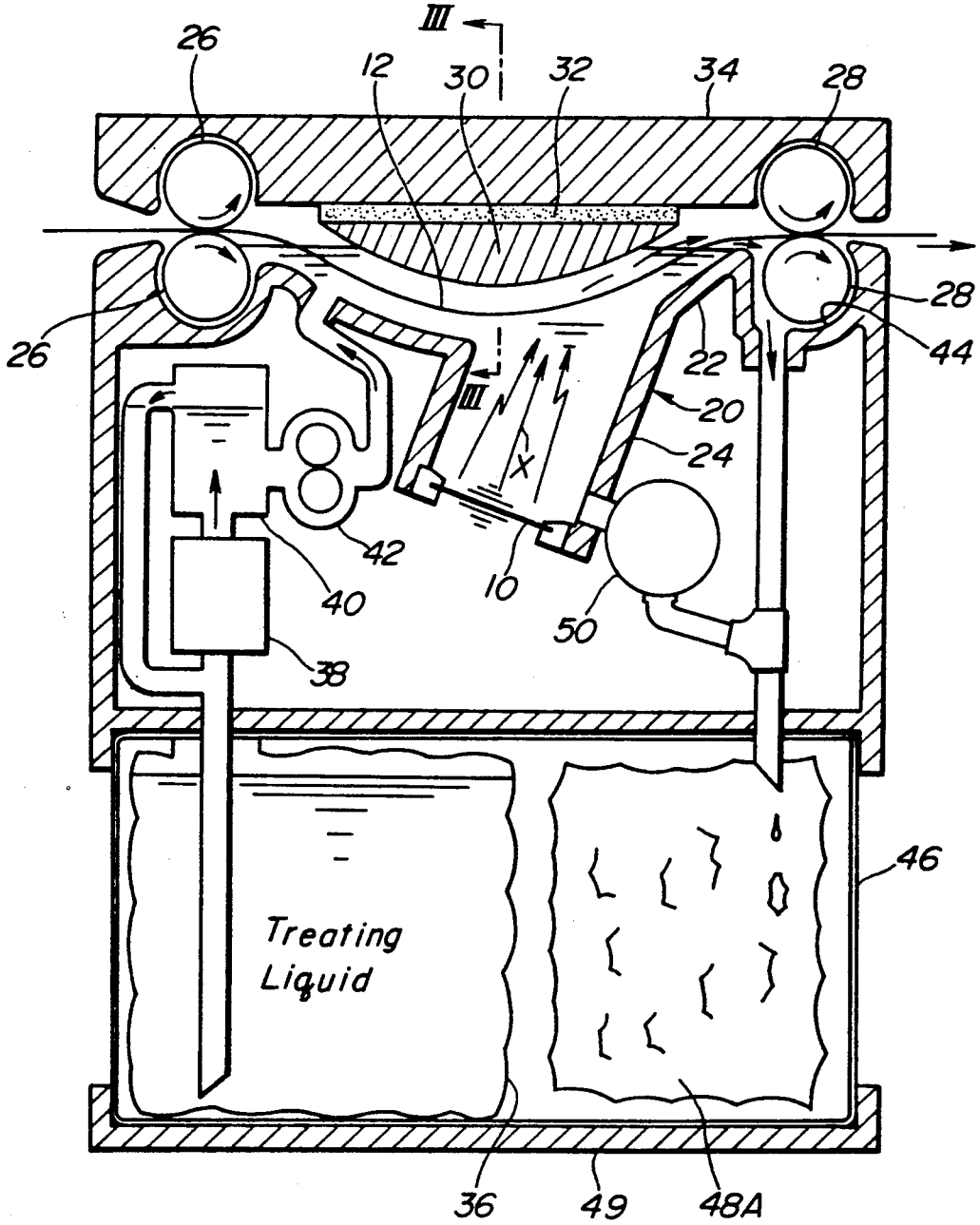
FIG. 1 is a schematic illustration showing a developing station according to one emdodiment of the invention.

In FIG. 1, a developing vessel is denoted by 20, in which disposed is a film guide member 22 having a generally arcuated contour when viewed in side elevation, the center of the guide member 22 being opened and communicated with a generally cylindrical ultrasonic wave propagating section 24 which is slanting relative to the pass along which a film 12 moves. In the illustrated embodiment, the film 12 moves from the left side to be immersed in the treating liquid along an arcuated pass and then moves out of the treating liquid at the right side. A pair of feed rollers 26 is disposed at the left end of the film guide member 22 to feed the film 12 into the treating liquid in the vessel 20, and another pair of guide rollers 28 is disposed at the right end of the film guide member 22 to pull the film out of the treating liquid.

Figure 3:
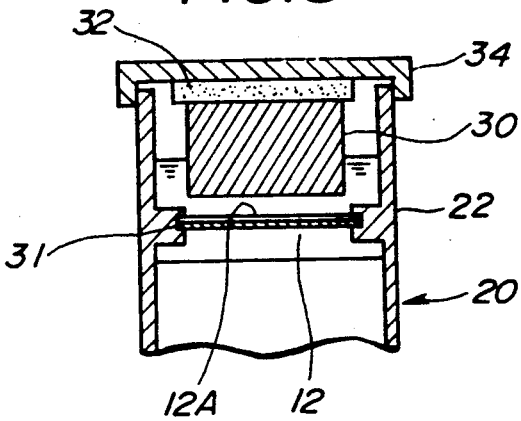
FIG. 3 is a sectional view taken along line III—III of FIG. 1.
Figure 4A:
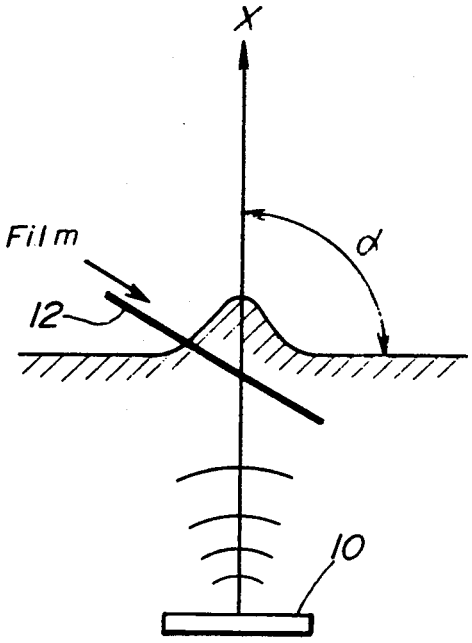
FIGS. 4A to 4D are diagrammatical illustrations given for the explanation of the principle of this invention.
Figure 4B:
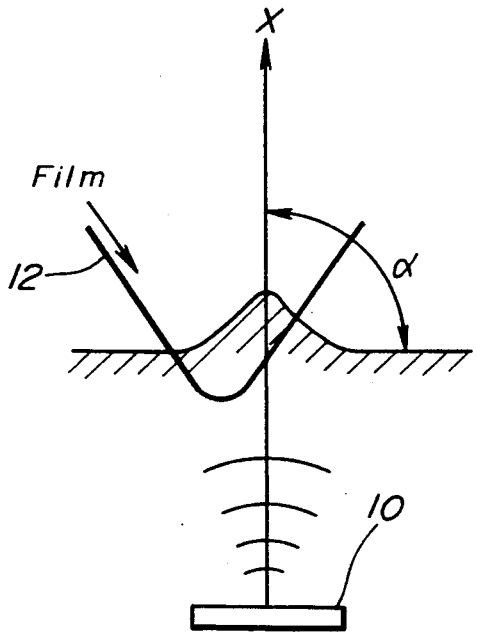
Figure 4C:
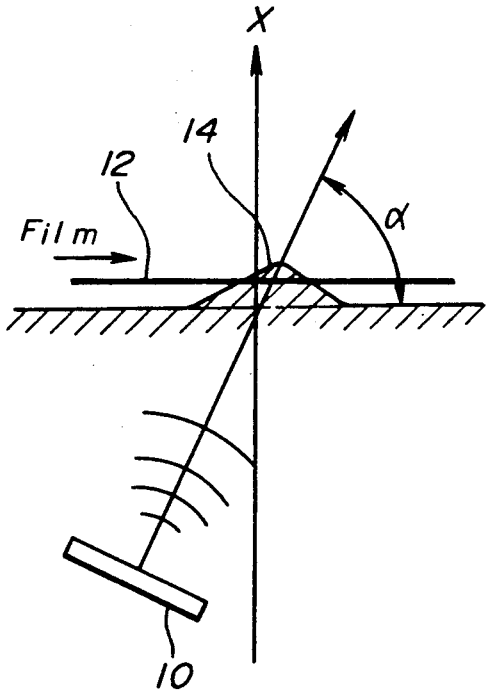
Figure 4D:
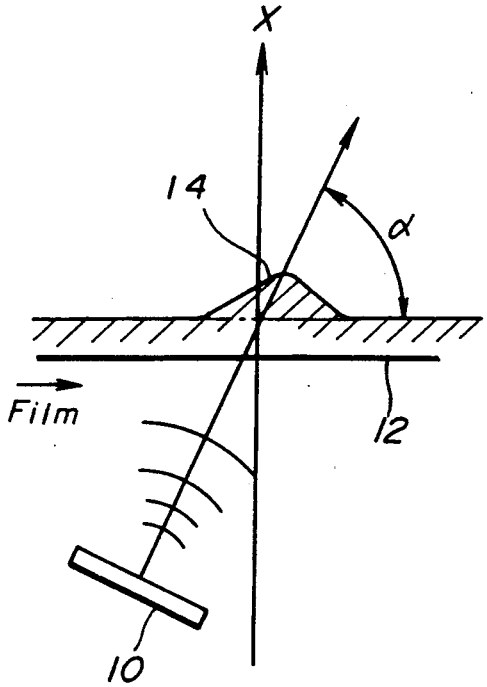

A liquid surface regulating member 30 made of, for example, neoprene or urethane rubber thrusts into the treating liquid. The member 30 has an arcuated section to ensure smooth travel of the film 12 and attached through a thermally insulating material 32 to a cover plate 34. A gap of about 3 to 4 mm is formed between the surface of the liquid surface regulating member 30 and the bottom surface of the film guide member 22 so that the film 12 moves through this gap while guided by guide grooves 31 (see FIG. 3). As shown in FIG. 3, the film guide member 22 is provided with grooves 31 into which the edges of the film 12 are received so that the film 12 moves in the treating liquid along a pass which is regulated by these grooves. In a preferred embodiment, the film 12 moves with its side 12A coated with the emulsion layer facing upside.

A circular disk-shaped vibrator 10, which serves as the ultrasonic wave generating means, having a diamter of about 25 mm is disposed at the bottom of the ultrasonic wave propagation section 24 with the perpendicular of the vibrator 10, i.e. the center axis X along which the ultrasonic wave has its maximum directivity, is slanting relative to the moving direction of the film 12. The film 12 enters the close distance sound range, which is described in detail hereinbefore. It is desirous that the intersection between the center axis X and the surface of the film 12 is apart from the vibrator 10 by a distance of from 10 to 50 mm.

The treating liquid is fed to the treating vessel 20 so that the liquid surface in the vessel 20 is held at a constant level. The treating liquid is supplied from a tank or treating liquid reservoir 36 to a constant level tank 40 in which the treating liquid is contained to form a liquid surface of constant level by a pump 38. Then, the treating liquid is fed from the tank 40 by a metering pump 42 into the gap between the film guide member 22 and the liquid surface regulating member 30 at a position upstream of the ultrasonic wave propagation section 24. The consumed treating liquid flows over a weir at the downstream end of the film guide member 22 to flow into a discharge chamber 44 from which it falls into a treating liquid pack 46.

Figure 2A:
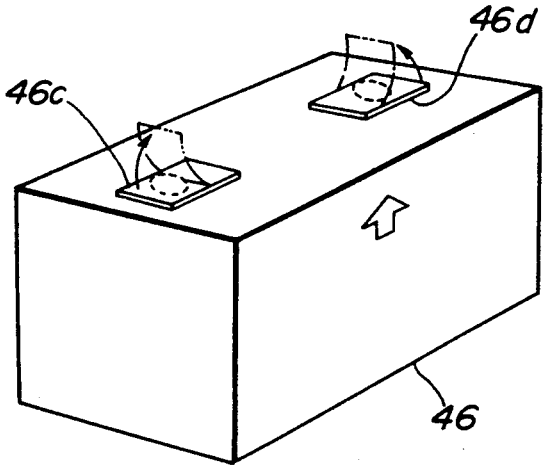
FIG. 2A is a perspective view showing the outer contour of a treating liquid pack used in the film processor of this invention.
Figure 2B:
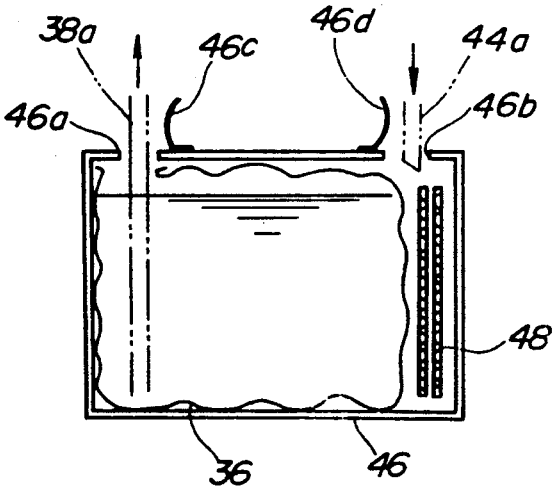
FIGS. 2B and 2C are sectional views showing the insides of the treating liquid pack of FIG. 2A, respectively, before and after the use.

The treating liquid pack 46 is formed of water-proof paper and has a general contour of rectangular hexahedron. As shown in FIG. 2B showing the treating liquid pack 46 prior to the use thereof, the treating liquid reservoir 36 containing the treating liquid and made of a flexible plastic material is contained within one side of the pack 46, and a water absorbing polymer 48 is contained within the other side in the pack 46. A fresh treating liquid outlet port 46*a* communicating the resevoir 36 with the pump 38 is formed through the top wall of the pack 46, and a consumed treating liquid inlet port 46*b* communicating the water-absorbing polymer 48 with the discharge chamber 44 is formed also through the top wall of the pack 46. Before use, each of these ports 46*a* and 46*b* is sealed by a thin film and further covered by a sealing members 46*c* or 46*d* coated with a tackifying material. The pack 46 is placed on a tray 49 which is movable along the vertical direction, with the sealing members 46*c* and 46*d* being peeled off (see FIG. 1), and the tray 49 is then raised. The thin sealing films covering the ports 46*a* and 46*b* are broken, respectively, by the lower end of a treating liquid sucking pipe 38*a* communicating with the pump 38 and the lower end of a treating liquid discharge pipe 44*a* communicating with the discharge chamber 44, so that the pack 46 is set to be ready for use.

Figure 2C:
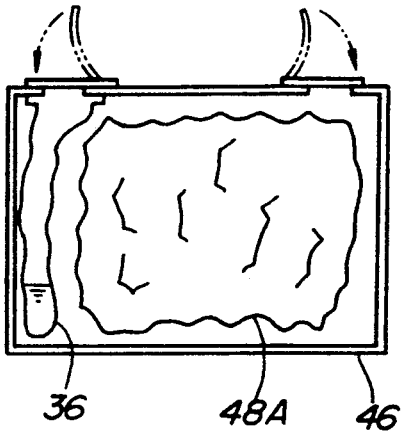

As the volume of the reservoir 36 is decreased with the consumption, of the treating liquid in the reservoir 36, the polymer 48 absorbs the consumed treating liquid to be gelled and to expand as denoted by 48A in FIG. 2C. When the treating liquid in the reservoir 36 is consumed entirely, the tray 49 is lowered to retract the pipes 38*a* and 44*a* out of the pack 46 to be ready for replacement. Although the consumed treating liquid forms gel with the polymer 48 to be prevented from spilling out of the housing of the pack 46, it is preferred that the ports 46*a* and 46*b* are covered again by the sealing members 46*c* and 46*d* to ensure prevention of leakage of the consumed treating liquid. By the use of the pack 46 as aforementioned, the operation of supplying the treating liquid can be considerably simplified.

The level or height of the surface of the treating liquid contained in the treating vessel is determined by the height of the weir of the discharge chamber 44 in which the paired guide rollers 28 are contained. For example, the height of the weir is set to be higher than the lowest bottom position of the arcuated film guide member 22 by about 7 mm. A valve 50 is mounted to the lowest position of the wall defining the ultrasonic wave propagation section 24 to discharge the whole volume of the treating liquid to the pack 46.

In the illustrated embodiment, the treating liquid is fed to the treating vessel 20 at a constant rate by means of the metering pump 42, and the liquid surface in the treating vessel 20 is held at a constant level which is defined by the height of the weir of the discharge chamber 44. The film 12 moves at a constant speed by the roller pairs 26 and 26, and is conveyed through the treating liquid by the film guide member 22 along a downwardly-projecting arcuated pass. The vibrator 10 generates ultrasonic wave of constant frequency (for example, 1.7 MHz) and constant energy, and the thus generated ultrasonic wave impinges on the film 10 obliquely. Accordigly, the film 10 moves across the distance which is longer than one cycle of the ultrasonic vibration containing both of the maximum and minimum amplitude range, so that the influence by the intensity of the ultrasonic vibration due to the periodical change in intensity of the vibration can be excluded. As a result, uniform and high quality processing of the film is realized.

The ultrasonic vibration exerts the function of selectively heating the high polymer material, such as the film base of the film 10, without heating the treating liquid. The liquid surface regulating member 30 serves to prevent radiation of heat to keep the film warm to uniformalize and accerelate the processing of the film. When the liquid surface regulating member 30 is made of a high polymer material, such as polyurethane or neoprene rubber, the member 30 per se is heated by its heat absorbing property upon exposure to the ultrasonic vibrations, whereby the film 10 is heated more rapidly to accerelate the processing thereof. Néoprene rubber is particularly preferred since it is excellent in heat resistant property. By interposing a heat insulating material 32 between the upper surface of the liquid surface regulating member 30 and the cover plate 34, as is the case of the illustrated embodiment, the temperature keeping effect by the member 30 is further improved so that the processing speed is further accerelated. As a result, the film can be processed within a short time to obtain the processed film of good quality without the occurrence of uneven processing.

Since the volume of the treating liquid above the upper surface of the film 12 is significantly smaller than the volume of the treating liquid below the film 12, the treating liquid above the film 12 can be heated rapidly. By facing the side of the film 12 on which the emulsion layer is coated upside, as shown in FIG. 3, processing of the film 12 may be carried out considerably rapidly.

Since the center axis X, along which the ultrasonic wave has its maximum directivity, is slanting to the direction along which the film 12 moves, the ultrasonic wave vibrations facilitate the transfer of the treating liquid along the moving direction of the film 12 so that fresh treating liquid is continuously supplied from the left end and flown from the left to the right, as viewed in FIG. 1.

Figure 8A:
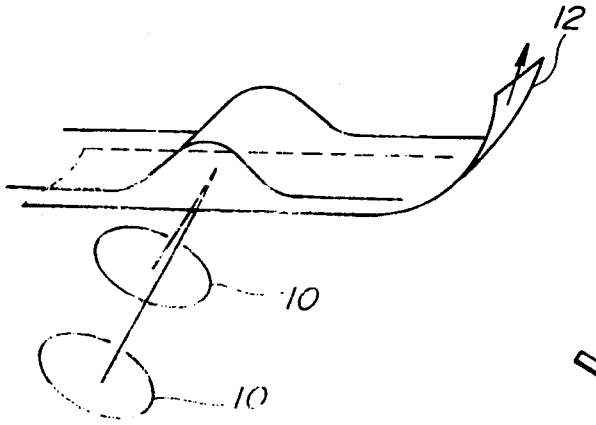
FIGS. 8A, 8B, 9A and 9B are diagrammatic illustrations showing various vibrator arrangement according to other examples of this invention.
Figure 8B:
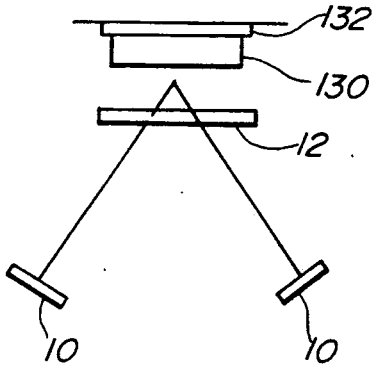

Although a single vibrator 10 has been used in the embodiment described above, plural vibrators 10 may be used without departing from the spirit and scope of this invention. FIGS. 8A and 8B are, respectively, a perspective view and a sectional view seen from the fore side of a further embodiment of this invention, in which two circular disk-shaped vibrators 10 are used. In this embodiment, two vibrators 10, 10 are disposed such that the center axes X, X of the two vibrators 10, 10 cross with each other at a vicinity of the surface of the film 12.

Figure 9A:
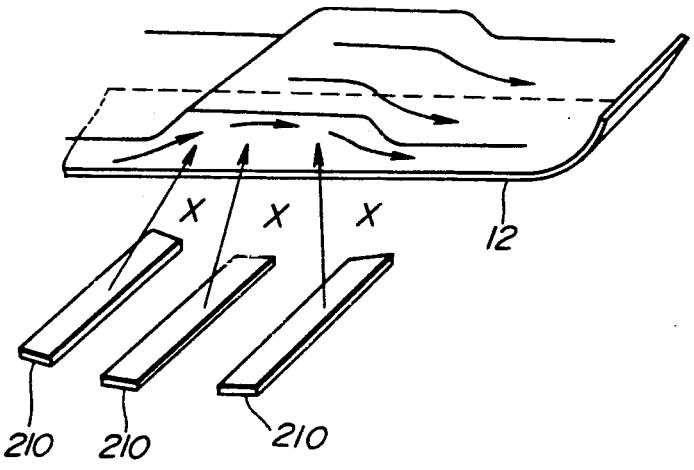
Figure 9B:
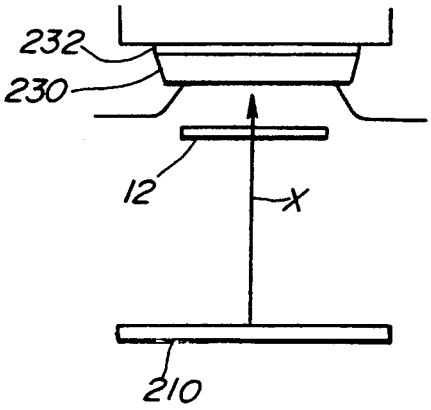

Similarly, FIGS. 9A and 9B show a still further embodiment of this invention wherein three rectangular vibrators 210 are used, FIG. 9A being a perspective view and FIG. 9B being a sectional view seen from the fore side of the treating vessel. The ultrasonic waves generated from respective vibrators 210 propagate along the center axes X to come close to each other at the vicinity of the film 12 to be processed. In the embodiments shown in FIGS. 8A, 8B, 9A and 9B, portions of the surface of the treating liquid rise upwards by the action of the ultrasonic wave vibrations. Liquid surface suppressing members 130 and 230 are provided to suppress such rising of the treating liquid to stabilize and uniformalize the flow of the treating liquid. Reference numerals 132 and 232 designate heat insulating materials.

The level of the treating liquid surface contained in the treating vessel 20 is maintained at a constant height by means of the weir of the discharge chamber 44 in the preceding embodiment. Alternatively, the level of the treating liquid surface may be controlled by the provision of a liquid surface sensor in combination of a discharge valve. The treating liquid is deteriorated, mainly due to oxidation, with the lapse of time. When the treating liquid in the treating vessel 20 is deteriorated to the extent that the replacement thereof is necessary, the valve 50 is opened while continuing the operations of the pumps 38 and 42 to discharge the consumed treating liquid to the partition of the pack 46 in which the water-absorbing polymer 48 is contained, whereby the discharged treating liquid is gelled for easy disposal.

Although the present invention has been described with reference to embodiments wherein the principle of the invention is applied to the developing station, the present invention includes those wherein the principle thereof are applied to any one or more of the treating stations including developing, fixing and rinsing stations.

Figure 10:
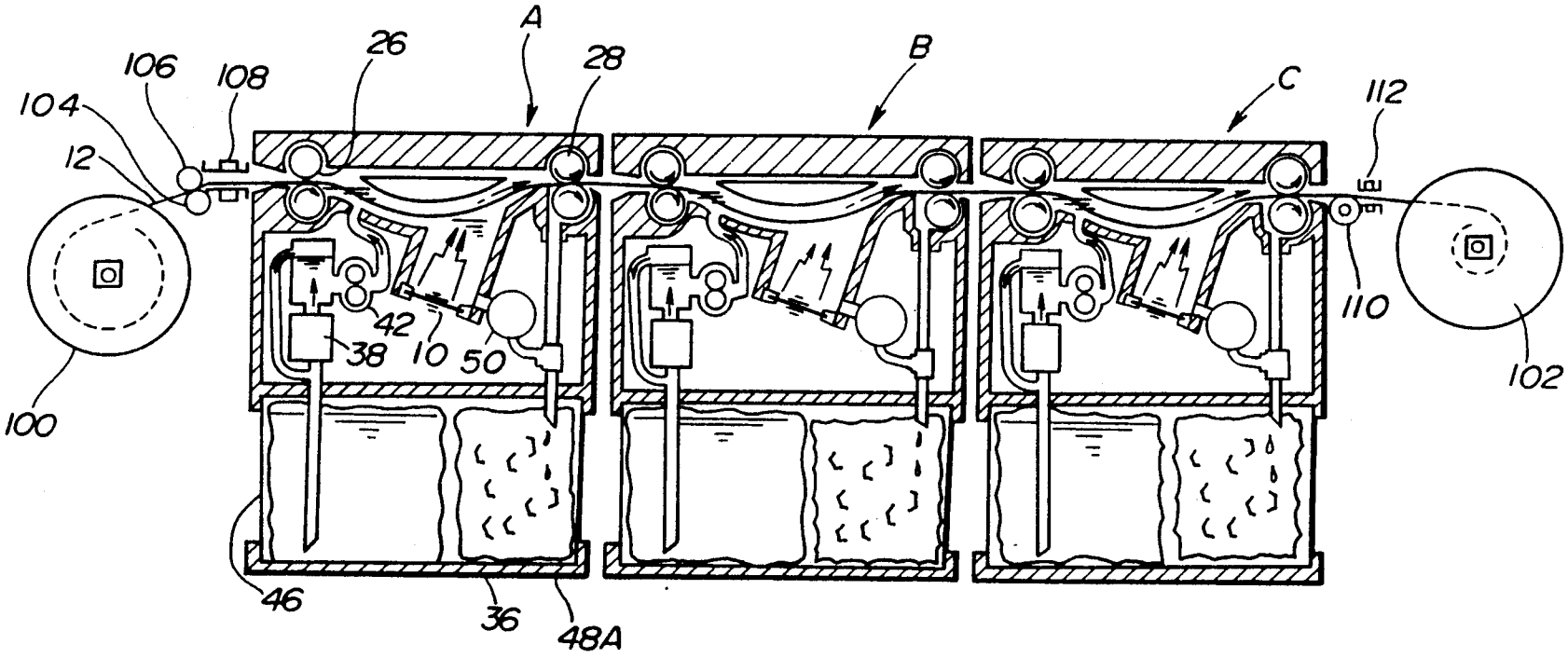
FIG. 10 is a sectional view showing an automatic film processor in which the embodiment shown in FIG. 1 is incorporated in each of the developing, fixing and rinsing stations.

FIG. 10 shows an automatic film processor embodying the present invention, in which the embodiment shown in FIG. 1 is incorporated not only in the developing station but also in the fixing and rinsing stations. In FIG. 10, A, B and C designate developing, fixing and rinsing stations, each of which has a similar construction as that shown in FIG. 1 except that developer solution, fixing solution and rinsing solution are used correspondingly in respective stations.

In each station, the film 10 is exposed to ultrasonic vibrations to be processed at a higher processing speed. In the developing station A, ultrasonic vibrations facilitate rapid impregnation of the developer solution into the photosensitive emulsion layer of the film 10 to promote the reaction between the latent image in the silver halide crystallites and the developing agent, so that reduction (blackening) of silver ions in the silver halide crystallites is accerelated. In the fixing station B, the solution velosity of silver halide is accerelated to increase the removal velosity for fixing. In the rinsing station C, rinsing operation for removing the fixing solution and silver thiosulfate or other salts from the film 12 is promoted by the action of ultrasonic vibrations.

In FIG. 10, an exposed but undeveloped film 12 is fed from a feed reel 100 to be taken up around a take-up reel 102. The film 12 to be developed is grasped by a driving roller 104 and a contact roller 106 to be fed to the developing station A. The fore and aft ends of the film 12 are sensed by an inlet sensor 108. The rotation of the contact roller 104 is monitored by an encoder (not shown). The film 12 is processed successively through the treating stations A, B and C, and then the processed film 12 is taken up around the take-up reel 102. An outlet roller 110 is rotatably engaged with the film 12 getting out of the rinsing station C, and the rotation of the outlet roller 110 is monitored by another encoder (not shown). An outlet sensor 112 is disposed at the vicinity of the outlet roller 110 to sense the fore and aft ends of the film 12.

The operation of the system of FIG. 10 will now be described. After setting an exposed film 12 on the reel 100, a power source switch (not shown) is turned on, whereupon the pumps 38 and 42 are actuated to feed the treating liquids, the liquid levels of which are maintained constant by continuous supplement of the treating liquids, and the rollers 26 and 28 are begun to rotate. As the film 12 is supplied from the reel 100 and passed through the rollers 104 and 106, the fore end thereof is sensed by the inlet sensor 108 and the vibrators 10 disposed in respective treating stations A, B and C are actuated in response to the output signal from the sensor 108. After being processed in respective treating stations A, B and C, the film 10 is taken up around the take-up reel 102. As the aft end of the film 12 is sensed by the outlet sensor 112, the vibrators 10 are stopped to cease the ultrasonic vibrations.

In this embodiment, occurrence of jamming in any of the treating stations A, B or C may be detected as follows. In one hand, in case where the outlet sensor 112 does not sense the fore end of the film 12 within a certain time period from the time at which the fore end of the film 12 is sensed by the inlet sensor 108, it is judged that jamming occurs at any one of the treating stations A, B or C. On the other hand, since the encoders for monitoring the rotations of the contact roller 106 and the outlet roller 110 count the feed amount of the film 12, in case where the roller 110 is stopped notwithstanding that the sensors 108 and 112 are still operated (namely, the film is continued to move), it is judged that jamming occurs at any one of the treating stations A, B or C. Meanwhile, it may be ascertained that the development of the film 12 has been completed under normal condition when the aft end of the film 12 is sensed by the outlet sensor 112 after a certain period from the time at which the fore end of the film 12 is sensed by the inlet sensor 108.

As will be understood from the foregoing, according to the present invention, the processing of the film is accerelated by the application of an ultrasonic wave in at least one treating stations, including developing, fixing and rinsing stations, the film being applied with the ultrasonic vibrations within the close distance sound range of the ultrasonic wave generating means, so that the spacing between the ultrasonic wave generating means and the moving film can be decreased to reduce the size of the treating vessel. In addition, since the moving direaction of the film is slanting relative to the direction along which the directivity of the output from the ultrasonic wave generating means takes the maximum value, according to another important feature of the invention, the film moves across an area applied with ultrasonic vibrations by a distance which covers more than one cycle of the vibration to exclude uneven processing due to the change in amplitude of the ultrasonic vibration. In a preferred embodiment, the ultrasonic wave is slanting to the direction along which the film moves so that the flow rate of the treating liquid is accerelated to facilitate supply of fresh treating liquid.

By providing a liquid surface regulating member to cover the upper surface of the treating liquid and moving the film along a pass spaced from the under surface of the liquid surface regulating member by a constant gap, in addition to the application of ultrasonic vibration from the downside of the film, the temperature of the film which is selectively heated by the application of ultrasonic vibration and the temperature of the treating liquid close to the film can be kept warm by preventing heat loss due to radiation or transfer of heat, whereby the processing speed is accerelated. As a result, the length or distance necessary for the film to be immersed in the treating liquid is minimized to enable reduction of the size of the treating vessel.

The temperature keeping effect by the liquid surface regulating member can be further enhanced by holding the member through a thermal insulating member.

In a further preferable embodiment, the ultrasonic wave is generated below the treating liquid to be applied to the downside of the travelling film while the photosensitive layer on the film facing upside, so that the volume of the treating liquid over the upside surface of the film is relatively samll and thus heated rapidly leading to the result that the photosensitive layer contacting with the thus heated treating liquid is processed rapidly. Accordingly, the time required for processing of the film can be decreased or the size of the required treating vessel can be reduced.

SECOND EMBODIMENT

Figure 11:
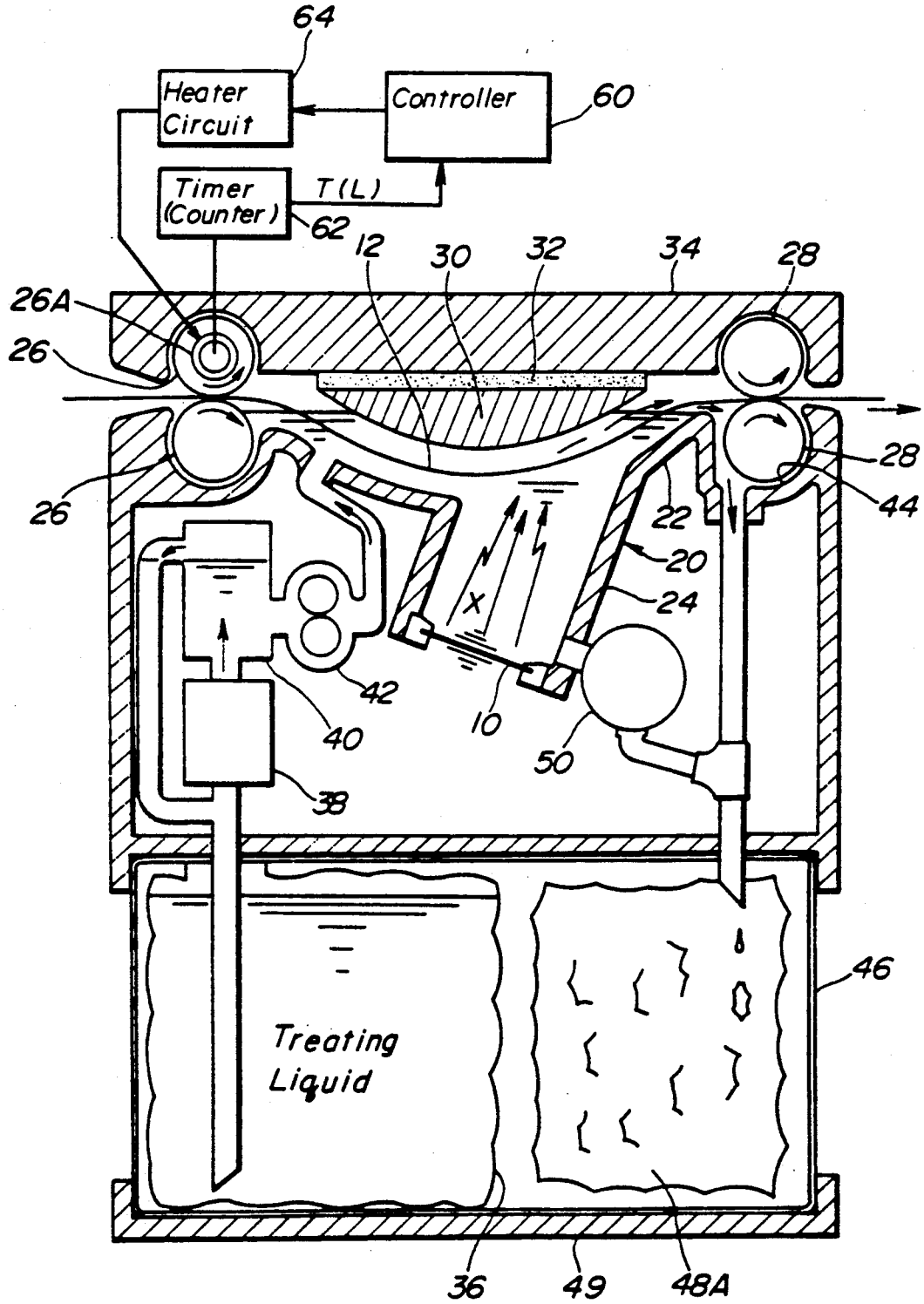
FIG. 11 a sectional view showing a developing station in which the second embodiment of this invention is incorporated.

A developing station, according to a second embodiment of the invention, is shown in FIG. 11. In this embodiment, one feed roller 26 is a heat roller containing therein an electric heater 26A made of, for example, a ceramics element having a high heat capacity, so that the roller 26 constitutes the preheating means to be heated to a desired temperature. As the film 12 is preheated by the feed roller 26 prior to entry into the developing vessel 20, the processing speed by the treating liquid is increased in addition to accerelation of processing by the application of ultrasonic vibrations.

A controller for controlling the preheating temperature is denoted by 60 in FIG. 11. As the input to the controller 60, the rate of treatment per a unit time is put in to find the necessary preheating temperature. The feed roller 26 is rotated at a constant speed in this embodiment, and the time during which the roller 26 rotates is integrated to use as a parameter for indicating the rate of treatment per a unit time. In detail, the time during which the roller 26 rotates is integrated by means of a timer 62 to find an integrated time T which is put into the controller 60. Alternatively, the timer 62 may be replaced by a counter which counts the number of rotation of the roller 26, and the length of the film 12 fed through the feed roller 26 is integrated to use the integraged length L as a parameter for controlling the preheating temperature.

Based on the thus found rate of treatment per a unit time, the controller 60 instructs a heater circuit 64 to control the temperature of the heater 26A at a proper temperature. Since the treating liquid becomes fatigued or deteriorated with the increase in amount of the film already treated by the treating liquid, the controller 60 instructs that the preheating temperature is gradually raised corresponding to the increase in the amount of film treated by the same batch treating liquid, whereby the density of the developed image is always maintained at a proper level.

The embodiment shown in FIG. 11 may be applied not only to the developing station A, but also to the fixing station B and the rinsing station C of the system shown in FIG. 10, where the preheating temperature may be controlled independently in respective stations depending on the integrated amount of treatment at respective stations. However, the most significant influence by the integrated amount of the film which has been already treated by one batch of the treating liquid appear in the developing station A, it is particularly preferred that the preheating temperature is controlled in the developing station by the application of this embodiment.

Other parts and other operations in this second embodiment are the same as in the first embodiment, and hence the descriptions thereof will not be given for the simplicity of explanation.

THIRD EMBODIMENT

Figure 12:
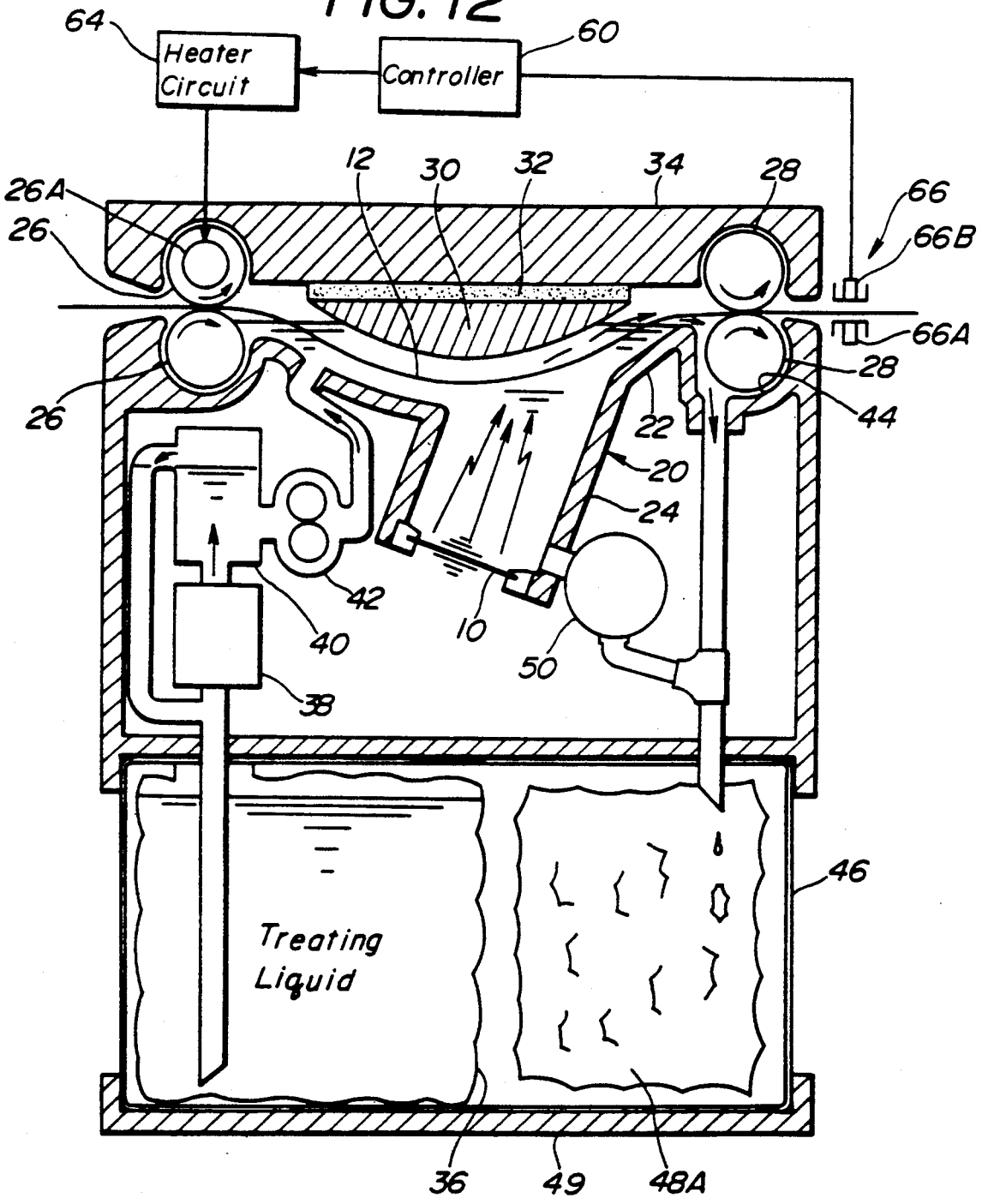
FIG. 12 is a sectional view showing a developing station in which the third embodiment of this invention is incorporated.

A developing station constructed in accordance with a third embodiment of this invention is shown in FIG. 12. In this third embodiment, the preheating temperature is controlled in response to the density of the developed image on the film 12.

The density of the developed image on the film 12 is detected by density detecting means 66, and the preheating temperature by the heat roller 26 is controlled in response to the density of the image detected by the density detecting means 66. Referring in detail to FIG. 12, the density detecting means 66 is disposed downstream of the outlet of the developing vessel, namely behind the guide roller pair 28 at the outlet of the station, and comprises a light emitting element 66A and a light receiving element 66B facing with each other by a gap through which the film 12 is dispensed. The density detecting means 66 detects the density of the image on the film 12 to generate an output signal indicating the density, and the output signal from the density detecting means 66 is fed to the controller 60 by which an optimum preheating temperature for obtaining the relevant density is computed. Then, the controller 60 instructs the heater circuit 64 to control the temperature of the heater 26A of the feed roller 26. If the density of the developed image is too low, the preheating temperature is raised to promote processing in the developing station. On the contrary, if the density of the developed image is too high, the preheating temperature is lowered to decelerate the processing rate. Thus, the density of the image on the developed film is controlled to be in a proper level.

Although it is preferred that the density detecting means 66 is disposed at the outlet of the developing station A, it may be disposed at the outlet of either one of the fixing station B or the rinsing station C.

Figure 13:
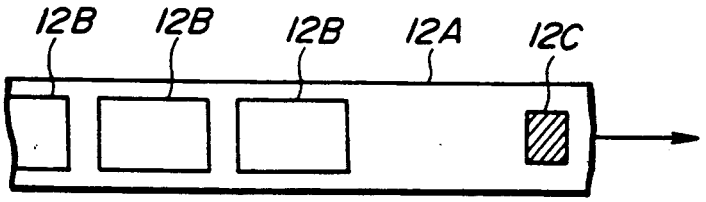
FIG. 13 shows another form of the film which is to be developed by the third embodiment of this invention.

However, when this embodiment is used, there arises a problem that a portion of the film has been already developed when the fore end of the film 12 reaches the density detecting means 66 and thus the portion of the film is developed without controlling the preheating temperature. This problem may be solved by the use of a film shown in FIG. 13. The film 12A shown in FIG. 13 has a portion 12C which has been exposed to a constant quantity of light, and the portion 12C precedes the image bearing portion 12B by a predetermined distance. By using the film 12A and detecting the density of the developed image in the portion 12C, the preheating temperature for the optimal development can be determined. The portion 12C may be provided by exposing the portion of the film preliminarily to a light, or may be exposed to a light at the inlet of the developing station A.

According to this embodiment, by varying the preheating temperature in response to the density of the developed image, the density of the developed image can be controlled at a constant level to stabilize the quality even if the developer liquid has been fatigued or deteriorated or the temperature of the developer liquid is changed.

FOURTH EMBODIMENT

Figure 14:
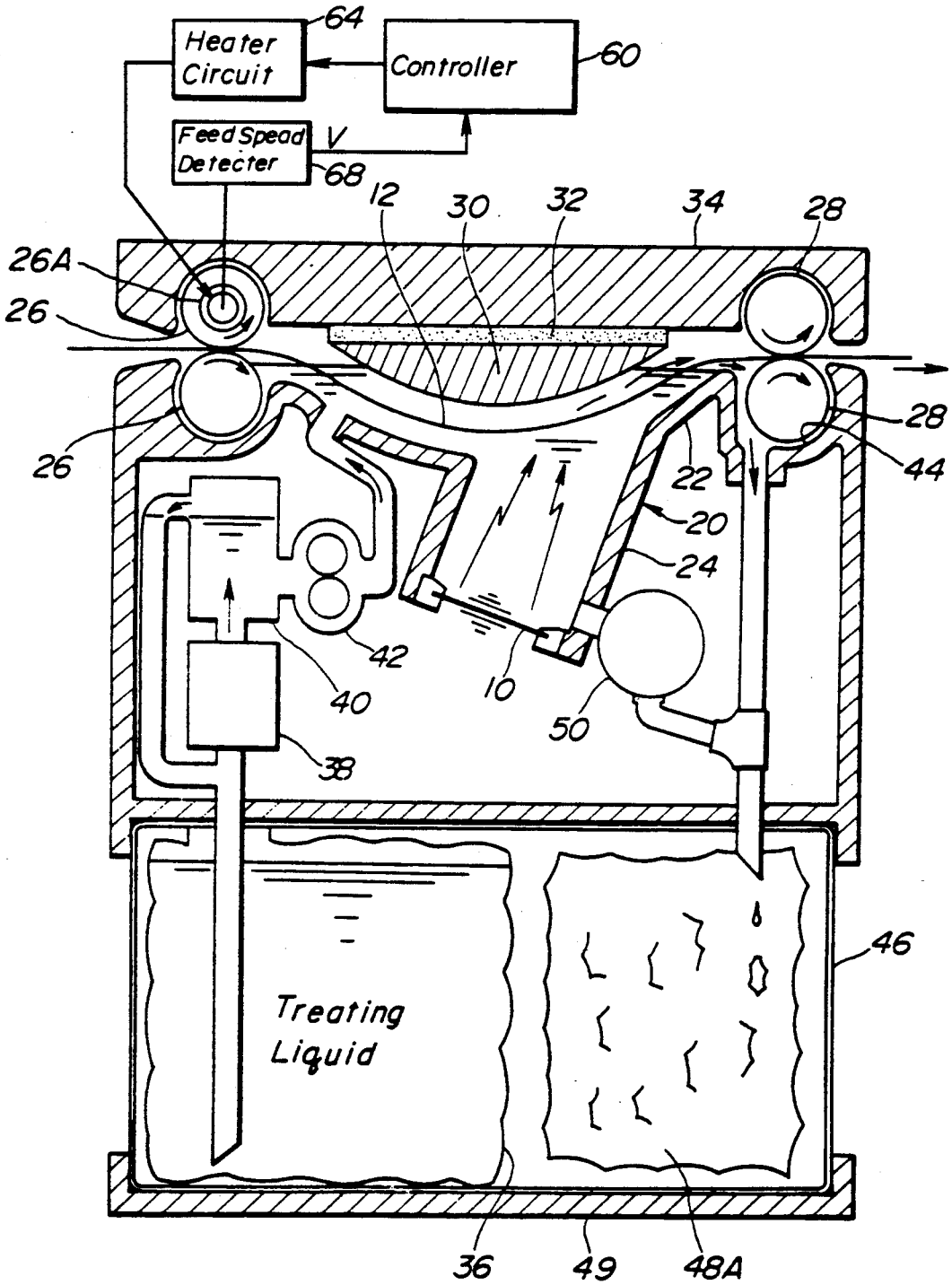
FIG. 14 is a sectional view showing a developing station in which the fourth embodiment of this invention is incorporated.

FIG. 14 shows a developing station constructed in accordance with a fourth embodiment of this invention. In the fourth embodiment, the preheating temperature is varied in response to the film feed speed in the developing station.

In the fourth embodiment, the processing speed is accelerated by the application of an ultrasonic vibrations and the preheating temperature of the film is varied in response to the change in film feed speed.

Referring to FIG. 14, a feed speed detector 68, as the means for detecting the moving speed of the film 12, comprises a rotary encoder for detecting the rotating speed of the feed roller 26. The moving speed V of the film 12 detected by the detector 68 is fed to a controller 60 which determines the preheating temperature depending on the moving speed V of the film 12.

The controller 60 instructs the heater circuit 64 to heat the heater 26A to a proper temperature. The density of the developed image is changed as the moving speed of the film 12 through the developing station is changed by any cause, such as change in resistance in the film conveying passage. In order to compensate such a change in density of the developed image to ensure that the developed image has a constant density, the preheating temperature should be lowered when the moving speed of the film 12 is decreased or the preheating temperature should be raised when the moving speed of the film 12 is increased. By varying the preheating temperature in response to the change in film feed speed, the film can be properly processed so that the density of the developed image can be stabilized.

Although the fourth embodiment has been described as it is incorporated in the developing station where the preheating temperature affects significantly the density of the developed image, a similar preheating temperature controlling device may be incorporated in the fixing station B and/or rinsing station C.

Although the film moving speed is determined by detecting the rotational speed of the feed roller 26, the same may be determined by detecting the rotational speed of the inlet roller 104 or the outlet roller 110 (see FIG. 10).

FIFTH EMBODIMENT

Figure 15:
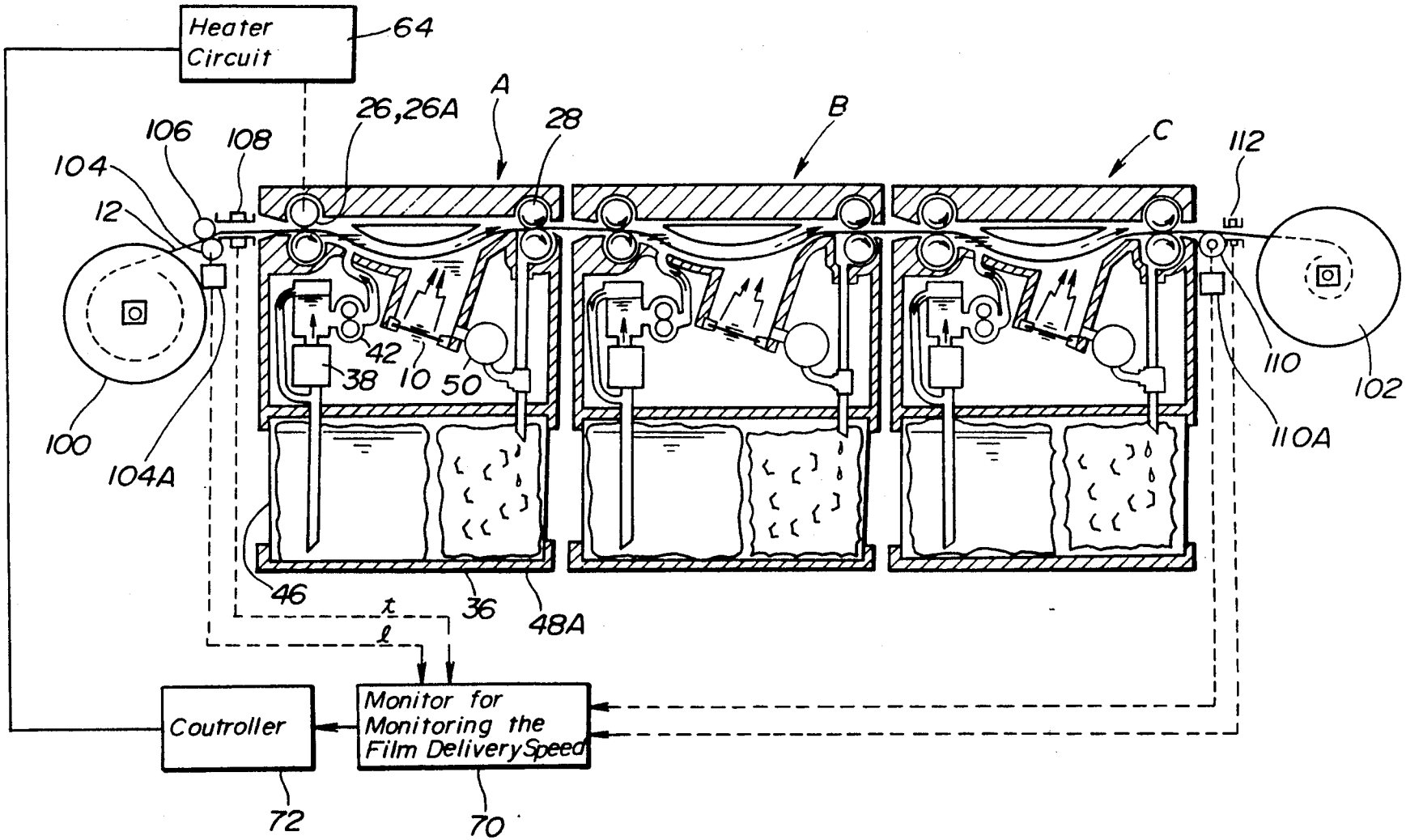
FIG. 15 is a sectional view showing an automatic film processor in which the fifth embodiment of this invention is incorporated.

FIG. 15 shows a developing station constructed in accordance with a fifth embodiment of this invention. In the fifth embodiment, the processing speed is accelerated by the application of an ultrasonic vibrations and preheating of the film is stopped when any abnormality is found in the delivery of the film. If the film is not delivered smoothly or jammed in any station when it is preheated according to the second, third or fourth embodiment, a portion of the film is over-heated to be damaged. According to the fifth embodiment, an automatic film processor is provided in which the film is prevented from over-heating even if the film is delivered under abnormal condition to ensure that the film is not damaged by over-heating.

Referring to FIG. 15, reference numeral 70 designates a monitoring means for monitoring the film delivery, reference numeral 72 designates a controller for controlling the preheating temperature and reference numeral 64 designates a heater circuit. The monitor 70 judges whether the film 12 is smoothly delivered through each treating station by monitoring the film feed rate 1 and the times t at which the fore and aft ends of the film 12 leave each treating station. The monitor 70 generates a signal for instructing the preheating temperature controller 62 to deenergize the heater 26A when any abnormality is found in delivery of the film 12.

The system shown in FIG. 15 has developing station A, fixing station B and rinsing station C, and each of these stations has a generally similar construction as that shown in FIG. 1 and developer solution, fixing solution and rinsing water are used respectively. The heater 26A may be preferably provided in the developing station A where the preheating temperature affects most significantly the result of processing. However, similar heaters may also be provided in the stations B and/or C.

An exposed but undeveloped film 12 is fed to the developing station A through the driving roller 104 and the contact roller 106. The fore and aft ends of the film 12 are sensed by the inlet sensor 108. The rotation of the contact roller 104 is monitored by an encoder 104A. The film 12 is preheated by the feed roller 26 of the developing station A and developed in the station A, and then fixed and rinsed respectively in the fixing and rinsing station B and C to be taken up around the take-up reel 102. The film 12 getting out of the rinsing station C engages with the outlet roller 110 to rotate the roller 110, and the rotation of the outlet roller 110 is monitored by the encoder 110A. An outlet sensor 112 is provided close to the outlet roller 110 to sense the fore and aft ends of the film 12. The output from these encoders 104A and 110A and the outputs from the inlet and outlet sensors 108 and 112 are fed to the monitor 60 to judge the presence or absence of abnormality.

The operation of this embodiment will now be described. An exposed film 12 is set the reel 100 and a power source switch (not shown) is turned on, whereupon the pumps 38 and 42 are actuated to feed the treating liquids, the liquid levels of which are maintained constant by continuous supplement of the treating liquids, and the rollers 26 and 28 begun to rotate. As the film 12 is supplied from the reel 100 and passed through the rollers 104 and 106, the fore end thereof is sensed by the inlet sensor 108 and the vibrators 10 disposed in respective treating stations A, B and C are actuated in response to the output signal from the sensor 108. After being processed in respective treating stations A, B and C, the film 10 is taken up around the take-up reel 102. As the aft end of the film 12 is sensed by the outlet sensor 112, the vibrators 10 are stopped to cease the ultrasonic vibrations.

The monitor 70 detects occurrence of jamming in any of the treating stations A, B or C in the manner as will be described hereinbelow. It is judged that jamming occurs when the difference $t_2-t_1$ is more than a certain time period, wherein $t_2$ is the time at which the outlet sensor 112 senses the fore end of the film 12 and $t_1$ is the time at which the inlet sensor 108 senses the fore end of the film 12. On the other hand, since the encoders for monitoring the rotations of the contact roller 106 and the outlet roller 110 count the feed amount of the film 12, in case where the roller 110 is stopped notwithstanding that the sensors 108 and 112 are still operated (namely the film is continued to move), it is judged that jamming occurs at any one of the treating stations. Meanwhile, it may be ascertained that the processing of the film 12 has been completed under normal condition when the aft end of the film 12 is sensed by the outlet sensor 112 after a certain period from the time at which the fore and of the film 12 is sensed by the inlet sensor 108.

When the monitor 70 detects any abnormality in delivery of the film 12, the controller 72 generates a signal to deenergize the heater 26A to stop preheating.

Since the preheating of the film is immediately stopped when any abnormality is found in delivery of the film, the film is prevented from over-heating even if it is jammed or not delivered smoothly through the treating stations to exclude damage of the film due to over-heating.

What is claimed is:

1. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film, said film being moved along a pass extending in the close range of a sound wave field including the remotest position at which an output sound pressure from said ultrasonic wave generating means takes the maximum amplitude, and said film having its face impinged by the ultrasonic wave generated by said ultrasonic wave generating means such that said face is not perpendicular to the direction along which said ultrasonic wave has its maximum directivity, whereby said film is moved across an area applied with the ultrasonic vibrations by a distance which covers more than one cycle of the ultrasonic vibration to exclude uneven processing due to the change in amplitude of the ultrasonic vibration.

2. The automatic film processor of claim 1, wherein said direction along which said ultrasonic wave has its maximum directivity is slanting relative to the moving direction of said film.

3. An automatic film processor for continuously developing an exposed film by passing said film successively through plural treating stations including developing, fixing and rinsing stations, which comprises:

a liquid surface regulating member provided in at least one of said plural treating stations, said member having its downside face contoured to define a film travel pass and dipped into a treating liquid used in said at least one treating station; and an ultrasonic wave generating means provided in said at least one of said plural treating stations for applying ultrasonic vibrations to said film from a lower portion of said treating liquid through said treating liquid towards said downside face of said liquid surface regulating member;

said film being moved along a pass held to be spaced from said downside face of said liquid surface regulating member by a substantially constant gap.

4. The automatic film processor of claim 3, further comprising a thermally insulating member, wherein said liquid surface regulating member is suspended by said thermally insulating member.

5. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from a lower portion of a treating liquid used in said at least one treating station, and preheating means for preheating said film prior to entrance into said treating liquid.

6. The automatic film processor of claim 5, wherein said preheating means comprises a pair of heat rollers which serve also as a feed roller pair to immerse said film into said treating liquid.

7. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from a lower portion of a treating liquid used in said at least one treating station, an integrator for integrating the amount of processing by said treating liquid, and preheating means for preheating said film prior to entrance into said treating liquid, the temperature of said film preheated by said preheating means is controlled depending on said amount of processing by said treating liquid.

8. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from a lower portion of a treating liquid used in said at least one treating station, density detecting means for detecting the density of the developed image on said film, and preheating means for preheating said film prior to entrance into said treating liquid, the temperature of said film preheated by said preheating means is controlled in response to said density of the developed image.

9. The automatic film processor of claim 8, wherein said preheating means comprises a pair of heat rollers which serve also as a feed roller pair to immerse said film into said treating liquid.

10. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from a lower portion of a treating liquid used in said at least one treating station, means for detecting the moving speed of said film conveyed through said treating liquid, and preheating means for preheating said film prior to entrance into said treating liquid, the temperature of said film preheated by said preheating means is controlled in response to said moving speed of said film.

11. An automatic film processor for continuously developing an exposed film by passing said film successively through plural treating stations including developing, fixing and rinsing stations, which comprises:

an ultrasonic wave generating means provided in at least one of said plural treating stations for applying ultrasonic vibrations to said film upwards from a lower portion of a treating liquid used in said at least one treating station, monitoring means for monitoring the condition of said film conveyed through said treating liquid, and preheating means for preheating said film prior to entrance into said treating liquid, preheating by said preheating means being stopped when any abnormality is detected by said monitoring means.

* * * * *